US005452794A

United States Patent [19]

DiVietro

[11] Patent Number: 5,452,794

[45] Date of Patent: Sep. 26, 1995

[54] PACKAGE COMPRISING CONTAINERS, CARRIER, AND TRAY

[75] Inventor: Victor G. DiVietro, Naperville, Ill.

[73] Assignee: Illinois Tool Works Inc., Glenview, Ill.

[21] Appl. No.: 238,360

[22] Filed: May 5, 1994

[51] Int. Cl.[6] ..... B65D 61/00; B65D 75/00

[52] U.S. Cl. ..... 206/150; 206/193; 206/427; 294/87.2

[58] Field of Search ..... 206/139, 142, 206/145, 146, 150, 151, 160, 161, 175, 176, 177, 178, 193, 194, 427, 428; 294/87.2

[56] References Cited

U.S. PATENT DOCUMENTS

| | | | |
|---|---|---|---|
| 3,094,210 | 6/1963 | Van Den Berg | 206/162 X |
| 3,700,275 | 10/1972 | Deasy | 294/87.2 |
| 3,923,155 | 12/1975 | Tanzer | 206/427 |
| 4,460,084 | 7/1984 | Miller | 206/150 X |
| 4,930,633 | 6/1990 | Gloyer | 206/428 |
| 4,974,726 | 12/1990 | Klygis et al. | 206/150 X |

*Primary Examiner*—Jacob K. Ackun
*Attorney, Agent, or Firm*—Schwartz & Weinrieb

[57] ABSTRACT

In a package, substantially identical bottles in a generally rectangular array are combined with a carrier and with a tray. The carrier is made from a single sheet of low density polyethylene so as to have band segments defining bottle-receiving apertures. The carrier is applied to the bottles so that outer band segments of the carrier embrace portions of side walls of the outer bottles in the array. The tray is made from a single sheet of cardboard and is folded so as to define a lower portion, underlying at least a portion of each bottle in the array, and two lateral portions. Each lateral portion is folded upwardly from the lower portion and is affixed adhesively to at least one of the outer band segments of the carrier. Outer surfaces of the lateral portions are suitable for imprinting or labelling.

18 Claims, 1 Drawing Sheet

PACKAGE COMPRISING CONTAINERS, CARRIER, AND TRAY

FIELD OF THE INVENTION

This invention pertains to an improved package comprising substantially identical containers, such as bottles for soft drinks or other beverages, together with a carrier and a tray. The tray provides expansive surfaces for pricing, barcoding, or other labelling of the improved package and provides means for separating and stabilizing like packages in a stack.

BACKGROUND OF THE INVENTION

Commonly, cans, bottles, or other containers for soft drinks or other beverages are marketed in packages comprising four, six, eight, or twelve containers in machine-applied carriers made from single sheets of resilient polymeric material, such as low density polyethylene. The carriers are made, as by die-cutting, so as to have band segments defining container-receiving apertures.

Although such polymeric carriers have many advantages, particularly as compared to predominantly paperboard carriers, such polymeric carriers have some shortcomings. One shortcoming is that such polymeric carriers do not provide expansive surfaces for pricing, barcoding, or other labelling of the packages. Another is that such polymeric carriers do not provide means for separating or stabilizing like packages in a stack.

This invention has resulted from efforts to provide an improved package for cans, bottles, or other containers for soft drinks or other beverages.

SUMMARY OF THE INVENTION

This invention provides an improved package comprising substantially identical containers, such as cans or bottles, which have side walls and which are arranged in a generally rectangular array including outer containers. The improved package provides expansive surfaces for pricing, barcoding, or other labelling and provides means for separating and stabilizing like packages in a stack.

The improved package further comprises a carrier made from a single sheet of resilient polymeric material, such as low density polyethylene, so as to have band segments defining container-receiving apertures and including outer band segments. The carrier is applied to the containers so that the container-receiving apertures receive the respective containers and so that the outer band segments embrace portions of the side walls of the outer containers.

The improved package further comprises a tray made from a single sheet of foldable material, preferably paperboard material, which is folded so as to define a lower portion underlying at least a portion of each container in the generally rectangular array and so as to define two lateral portions. Each of the lateral portions is folded upwardly from the lower portion at a fold in the folded sheet and is affixed to at least one of the outer band segments of the carrier.

Preferably, each of the lateral portions is affixed adhesively to at least one of the lateral portions of the carrier. More preferably, each of the lateral portions is affixed adhesively to at least two of the outer band segments of the carrier.

The lateral portions of the tray provide expansive surfaces for pricing, barcoding, or other labelling of the improved package. The lower portion of the tray provides means for separating like packages in a stack so as to stabilize the stacked packages.

BRIEF DESCRIPTION OF THE DRAWINGS

These and other objects, features, and advantages of this invention will be evident from the following description of a preferred embodiment of this invention with reference to the accompanying drawings, wherein like reference characters designate like or corresponding parts throughout the several views, and wherein.

DETAILED DESCRIPTION OF PREFERRED EMBODIMENT

Figure 1:
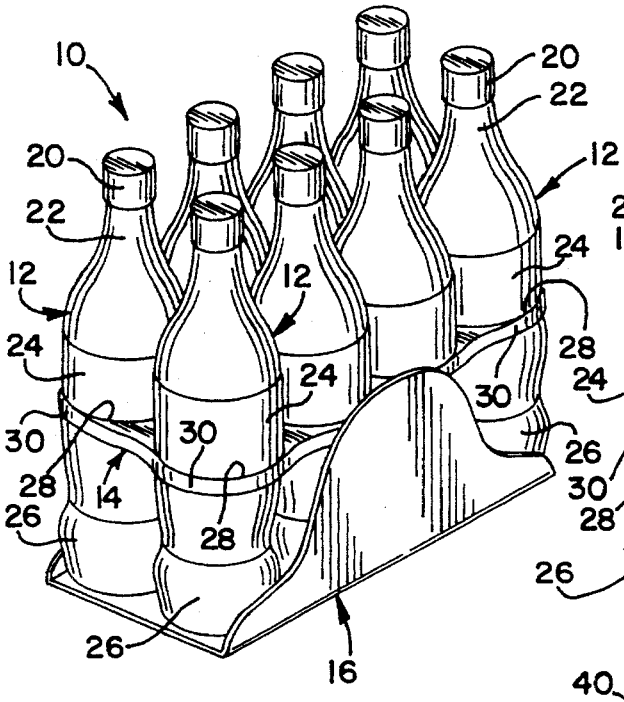
FIG. 1 is a perspective view of an improved package according to this invention and comprising eight substantially identical bottles, a polymeric carrier, and a paperboard tray.
Figure 2:
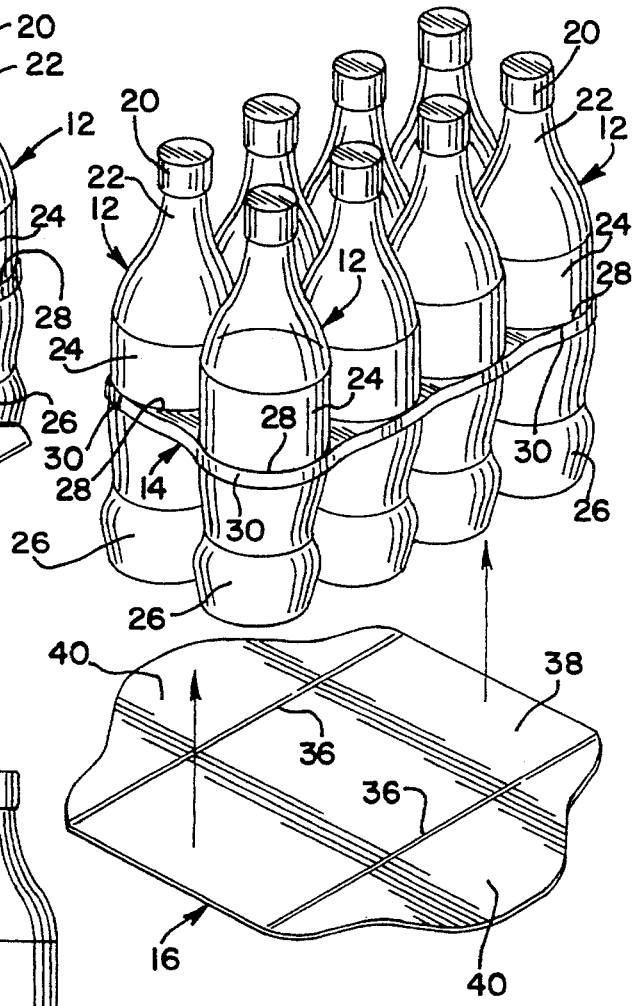
FIG. 2 is an exploded view of the package, as shown in FIG. 1, after the carrier has been applied to the bottles but before the paperboard tray is positioned beneath the bottles, folded, and secured and carrier.

As shown, a package 10 comprising eight substantially identical bottles 12, a polymeric carrier 14, and a paperboard tray 16 constitutes a preferred embodiment of this invention. The bottles 12 are arranged in a generally rectangular array including two longitudinal rows, each including four bottles 12. This invention contemplates that the generally rectangular array may include more than two rows, a different number of bottles 12 in each row, or both.

The bottles 12 may be predominantly polymeric bottles containing soft drinks. Each bottle 12 has a removable cap 20, which is mounted on a neck 22 of such bottle 12, a side wall 24, which is disposed below the neck 22, and a base 26, which is disposed below the side wall 24.

The carrier 14 is made, as by die-cutting, from a single sheet of resilient polymeric material. A preferred material is low density polyethylene. A preferred thickness for such material, if low density polyethylene is used, is about 16 mils. Any of various known carriers made from carrier stock available commercially from ITW Hi-Cone (a division of Illinois Tool Works Inc.) of Itasca, Ill., may be suitably used as the carrier 14.

The carrier 14 is made so as to have band segments defining bottle-receiving apertures 28 and including outer band segments 30. The carrier 14 is applied to the bottles 12, as by known machinery, so that the bottle-receiving apertures 28 receive the respective bottles 12 and so that the outer band segments 30 embrace portions of the side walls 24 of the bottles 12 in the outer rows. Suitable carrier-applying machinery is available commercially from ITW Hi-Cone, supra.

The tray 16 is made from a single sheet of foldable, paperboard material, which may be single-ply paperboard, multi-ply paperboard, or corrugated paperboard with a single wall or with double walls. Single-ply paperboard is preferred.

The tray 16 is folded along parallel folding lines 36 so as to define a lower portion 38 and two lateral portions 40. After the carrier 14 has been applied to the bottles 12, the tray 16 and the bottles 12 are disposed so that the lower portion 38 underlies the bases 26 of the respective bottles 12, whereupon the lateral portions 40 are folded upwardly from the lower portion 38.

The lateral portions 40 are affixed adhesively to the certain of the outer band segments 30. Preferably, as shown, each of the lateral portions 40 is affixed adhesively to the outer band segments 30 embracing portions of the side walls 24 of the middle two of the bottles 12 in a respective one of the rows. Any of a wide range of adhesives is suitable.

Figure 3:
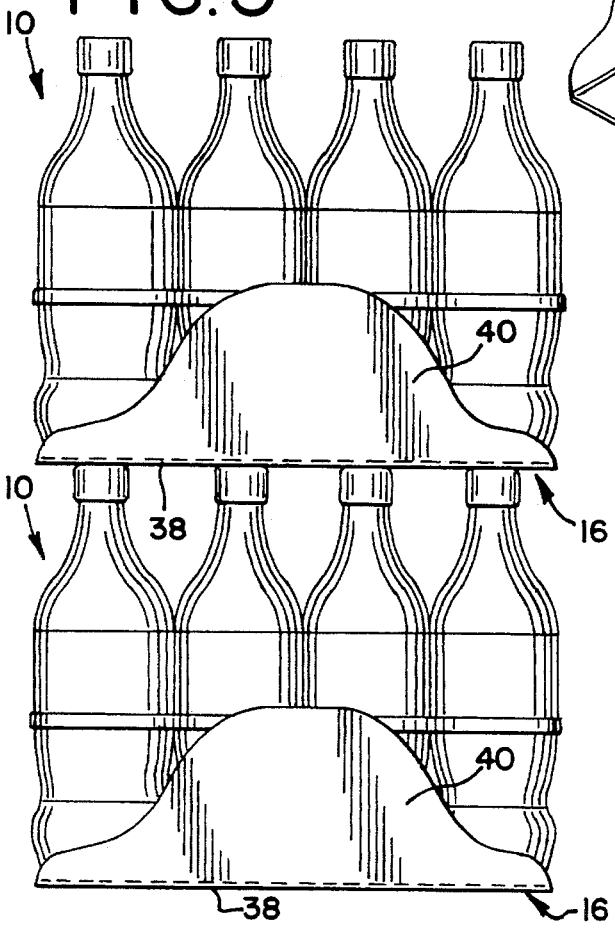
FIG. 3 is an elevational view of two such packages in a stack.

Particularly on the lateral portions 40 and additionally on the lower portion 38, the tray 16 provides expansive surfaces for pricing, barcoding, or other labelling of the package 10, by means of imprinting or otherwise. Nonetheless, substantial portions of the respective bottles 12 remain exposed, which is desirable from a marketing standpoint. Furthermore, as shown in FIG. 3, the lower portion 38 of the tray 16 is useful for separating and stabilizing like packages 10 in a stack.

Although it is preferred for the lateral portions 40 to be adhesively affixed as and where noted above, the lateral portions 40 may be heat-sealed if suitable coatings or suitable materials are employed.

Various other modifications may be made in the preferred embodiment described above without departing from the scope and spirit of this invention. It is therefore to be understood that within the scope of the appended claims, the present invention may be practiced otherwise than as specifically described herein.

I claim:

1. A package, comprising:

a plurality of substantially identical containers, each container having a base, and a body portion extending upwardly from said base and including an annular side wall, said containers being arranged in a substantially rectangular array;

a carrier comprising a single sheet of resilient polymeric material having band segments defining container-receiving apertures, said carrier being applied to said containers so that each one of said container-receiving apertures receives a respective one of said containers and wherein said band segments embrace portions of said side walls of said containers; and a tray comprising a single sheet of foldable material which is folded so as to define a tray support which is disposed beneath at least a portion of each one of said bases of said containers disposed in said substantially rectangular array for supporting said plurality of containers disposed in said substantially rectangular array, and a pair of lateral portions extending upwardly from opposite sides of said tray support and being respectively affixed to external portions of at least one of said band segments of said carrier disposed upon opposite sides of said substantially rectangular array of containers so as to unitize and stabilize said package.

2. The package of claim 1 wherein each of the lateral portions of the tray is affixed adhesively to at least one of the band segments of the carrier.

3. The package of claim 1 wherein each of the lateral portions of the tray is affixed adhesively to at least two of the band segments of the carrier.

4. A package, comprising:

a plurality of substantially identical bottles, each bottle having a base, and a body portion extending upwardly from said base and including an annular side walls, said bottles being arranged in a substantially rectangular array;

a carrier comprising a single sheet of resilient polymeric material having band segments defining bottle-receiving apertures, said carrier being applied to said bottles so that each one of said bottle-receiving apertures receives a respective one of said bottles and wherein said band segments embrace portions of said side walls of said bottles; and a tray comprising a single sheet of foldable material which is folded so as to define a tray support which is disposed beneath at least a portion of each one of said bases of said bottles disposed in said substantially rectangular array for supporting said plurality of bottles disposed in said substantially rectangular array, and a pair of lateral portions extending upwardly from opposite sides of said tray support and being respectively affixed to external portions of at least one of said band segments of said carrier disposed upon opposite sides of said substantially rectangular array of bottles so as to unitize and stabilize said package.

5. A package, comprising:

a plurality of substantially identical bottles, each bottle having a base, and a body portion extending upwardly from said base and including an annular side wall, said bottles being arranged in a substantially rectangular array;

a carrier comprising a single sheet of resilient polymeric material having band segments defining bottle-receiving apertures, said carrier being applied to said bottles so that each one of said bottle-receiving apertures receives a respective one of said bottles and wherein said band segments embrace portions of said side walls of said bottles; and a tray comprising a single sheet of foldable material which is folded so as to define a tray support which is disposed beneath at least a portion of each one of said bases of said bottles disposed in said substantially rectangular array for supporting said plurality of bottles disposed in said substantially rectangular array and for permitting said substantially rectangular array of said bottles to be supported upon a substantially similar rectangular array of bottles, and a pair of lateral portions extending upwardly from opposite sides of said tray support and being respectively affixed to external portions of at least one of said band segments of said carrier disposed upon opposite sides of said substantially rectangular array of bottles so as to unitize and stabilize said package.

6. A package as set forth in claim 4, wherein:

each one of said lateral portions of said tray is adhesively affixed to at least one of said band segments of said carrier.

7. A package as set forth in claim 4, wherein:

each one of said lateral portions of said tray is adhesively affixed to at least two of said band segments of said carrier.

8. A package as set forth in claim 5, wherein:

each one of said lateral portions of said tray is adhesively affixed to at least one of said band segments of said carrier.

9. A package as set forth in claim 5, wherein:

each one of said lateral portions of said tray is adhesively affixed to at least two of said band segments of said carrier.

10. A package as set forth in claim 1, wherein:

said carrier is fabricated from polyethylene.

11. A package as set forth in claim 4, wherein:

said carrier is fabricated from polyethylene.

12. A package as set forth in claim 5, wherein:

said carrier is fabricated from polyethylene.

13. A package as set forth in claim 1, wherein:

said tray is fabricated from paperboard.

14. A package as set forth in claim 4, wherein:

said tray is fabricated from paperboard.

15. A package as set forth in claim 5, wherein:

said tray is fabricated from paperboard.

16. A package as set forth in claim 1, wherein:

said substantially rectangular array of said containers comprises two longitudinal rows of said containers wherein each row comprises four containers.

17. A package as set forth in claim 4, wherein:

said substantially rectangular array of said bottles comprises two longitudinal rows of said bottles wherein each row comprises four bottles.

18. A package as set forth in claim 5, wherein:

said substantially rectangular array of said bottles comprises two longitudinal rows of said bottles wherein each row comprises four bottles.

* * * * *